United States Patent [19]

Chang et al.

[11] Patent Number: 4,743,919

[45] Date of Patent: May 10, 1988

[54] MICROWAVE FREQUENCY SELECTIVE SURFACE HAVING FIBROUS CERAMIC BODY

[75] Inventors: Stanley S. Chang, Palos Verdes Estates; Hui Bau, Hermosa Beach, both of Calif.

[73] Assignee: Hughes Aircraft Company, Los Angeles, Calif.

[21] Appl. No.: 916,355

[22] Filed: Oct. 7, 1986

[51] Int. Cl.[4] ..... H01Q 15/14; H01Q 15/16

[52] U.S. Cl. ..... 343/914; 333/202; 333/245; 343/909

[58] Field of Search ..... 333/202, 208–212, 333/245, 248, 21 A, 21 R; 343/907–914, 756, 872, DIG. 2

[56] References Cited

U.S. PATENT DOCUMENTS 4,652,891 3/1987 Bossuet et al. ..... 343/909

4,656,487 4/1987 Sureau et al. ..... 343/909

*Primary Examiner*—Marvin L. Nussbaum

*Attorney, Agent, or Firm*—S. M. Mitchell; M. J. Meltzer; A. W. Karambelas

[57] ABSTRACT

A frequency selective surface having a fibrous ceramic material body and a metallic grid on a reflecting face thereof. The body is formed by bonding a mass of silicon dioxide fibers together at their intersection points, as with a fusing agent such as boron nitride in a sintering process, resulting in an array of fibers with cellular porosity intentionally distributed through the body to reduce its density. Other types of ceramic fibers can be used either alone or in combination with the silicon dioxide fibers. The grid is attached to the reflecting surface or deposited thereon. The frequency selective surface finds particular utility in satellite microwave communications satellites.

17 Claims, 1 Drawing Sheet

MICROWAVE FREQUENCY SELECTIVE SURFACE HAVING FIBROUS CERAMIC BODY

BACKGROUND OF THE INVENTION

This invention relates to communications systems, and, more particularly, to a material that reflects selected frequencies of microwave radiation.

Satellites are used to carry a large part of the private and government communications throughout the United States and the world. In the most basic satellite communications system, a ground transmitting antenna transmits a signal to a satellite receiving antenna mounted on a satellite in orbit above the earth. The signal is then transmitted by a transmitting antenna on the satellite to other spacecraft or to a ground receiving antenna. The signal can also be modified by the satellite, as by amplifying it before retransmission. Because the satellite is usually thousands of miles above the earth in a geostationary orbit, this procedure allows signals to be transmitted through the satellite to ground receiving stations thousands of miles from the ground transmitting station. This satellite transmission technique makes possible the beaming of television signals from central locations directly to local cable companies and backyard television dish receivers, as well as voice, data and other types of transmissions.

A major consideration in the design of satellite communications systems is the continuing need to reduce the weight of the components in orbit. The cost of raising one pound to geostationary orbit is thousands of dollars. Weight reduction anywhere in the system can be directly viewed in terms of reduced costs, or alternatively, in terms of added capability that may be furnished in place of the reduced weight.

Since the volume of satellite communications traffic is increasing, there is also a continuing need to provide more communications channels. This growth can be supplied either by launching more satellites, or by increasing the number of channels that can be carried by each satellite. Either of these alternatives may require the launching of additional pounds of hardware into orbit, at the high cost discussed previously, although the first alternative of launching more communications satellites would have a higher cost because of the need to duplicate systems already on orbiting satellites, such as the propulsion and guidance systems.

Most satellite communications are transmitted on microwave signals having frequencies of about 1000 megahertz and higher. To permit several different frequency ranges to be transmitted through a single antenna system, it has been proposed to provide a passive mechanical device that can be used to separate microwave signals of differing frequencies by selectively reflecting one frequency to a transceiver and passing other frequencies to further processing or to a transceiver. Such a device is termed a microwave frequency selective surface. The frequency selective surface would make possible the transmitting of a signal to the satellite having a number of different frequencies or channels. Each channel could then be selectively reflected out of the beam to its own processing electronics, obviating the need for separate electronics to perform the separation function. If the weight of the frequency selective surface were less than that of the electronics replaced, then there would be a net weight reduction of the satellite.

To make such a frequency selective surface feasible, the material used to construct it must have a number of characteristics which heretofore have not been available. The material should be formable into a flat or curved piece with sufficiently high modulus of elasticity and strength to hold its shape precisely during launch. The material should have a low coefficient of thermal expansion and expand generally isotropically, to minimize the effects of heating and cooling if the material is exposed to alternating direct sunlight and shade. When the material is heated by the sun, it expands. The expansion ideally would be negligibly small, so that uneven heating would not cause the frequency selective surface to wrap, which might degrade the microwave signal. Even if the device is heated evenly, anisotropic expansion can cause distortion.

The material of construction must have a surface finish that does not interfere with the signal. Since the wavelength of the signal may be as low as one-fifth of a thousandth of an inch, the surface of the frequency selective surface must be even smoother to avoid interference with the signal. The material of the body should have a low dielectric constant to minimize refraction of the signal by the device, and a low dissipation factor to minimize attenuation or signal loss by the body of the microwave frequency selective surface. The material of the body must permit application of any surface coatings or structures required to perform the frequency selection.

The material of the body of the microwave frequency selective surface should experience low outgassing in a space environment, since evolution of gas can interfere with operation of the satellite. It is also highly desirable that the material be stable to high temperatures to resist damage by intense beams of energy that might be directed against the surface, such as a high intensity laser beam that would burn holes in it or distort it. High temperature capability would allow the satellite to resist attack more effectively by lasers or other directed energy weapons, without the need for specialized shielding and defensive measures. Finally, it would be desirable to construct the device of a material having characteristics such as density, surface structure, and composition that can be varied over ranges to permit designers flexibility in their selection of frequency selective surfaces for different requirements, always using a basic material of construction with which they are familiar and for which data is readily available.

This combination of characteristics has not heretofore been available. Accordingly, there is a need for a material having the above properties for use in constructing the body of a microwave frequency selective surface. The present invention fulfills this need, and further provides related advantages.

SUMMARY OF THE INVENTION

The present invention is embodied in a microwave frequency selective surface with a body of a material having a low, isotropic coefficient of thermal expansion and high temperature capability to resist damage by high energy beams. The material has a low dielectric constant and low dissipation factor to reduce distortion and attenuation of the microwave signal. The material can be made smooth, to minimize interference with the microwave signal and to receive the necessary structure to enable the frequency selection.

In accordance with the invention, a frequency selective surface for selectively reflecting microwave radiation comprises a body of a cellular ceramic material wherein a plurality of ceramic fibers are bonded together at their points of intersection to form a rigid structure having open cells dispersed therethrough and a reflecting face, and a metallic grid on the reflecting face, the grid having a repeating pattern of elements, which pattern passes a first frequency and reflects a second frequency of incident microwave radiation.

The body can be curved or flat, as long as the grid pattern can be placed thereon. With the processing technique to be described, the body can be made of substantially uniform density, or can be given gradations of density either laterally or through its thickness. The body preferably includes fibers of silicon dioxide and possibly aluminum oxide. A bonding agent is included in the body to bond the fibers together, preferably a fusing agent such as boron nitride to assist in the fusing of the mass of fibers together at their points of intersection. A preferred composition of the body is about 74 percent silicon dioxide fibers, 20 percent aluminum oxide fibers, 3 percent boron nitride, and 3 percent silicon carbide. The density of the body can be varied widely during processing of the fibers into the finished form, but is preferably from about 0.1 to about 0.5 grams per cubic centimeter.

The metallic grid is applied as a thin array of elements chosen for their ability to yield the desired microwave selectivity to the final grid. The grid is preferably very thin, on the order of about 1 micrometer in thickness. The grid can be applied directly to the reflecting surface of the body, as by vapor deposition. Alternatively, it can be prepared separately, as by depositing the metal onto a nonconducting substrate. The substrate can be used to transfer the deposited metal to the body for direct application thereto. The grid typically can be any electrical conductor, but gold, copper and tungsten, and alloys thereof are preferred. The presently preferred grid is a rectilinearly repeating pattern of flat-ended regular gold crosses shaped like a plus sign (+) but having a crossbar at the end of each arm of the plus sign, a shape sometimes known as a Jerusalem cross. The crosses are each about 1 micrometer thick, vacuum vapor deposited onto a piece of nonconducting plastic film, which is then bonded to the body with an adhesive.

More generally, a frequency selective surface for selectively reflecting microwave radiation comprises a body of a cellular ceramic material wherein a plurality of ceramic fibers are bonded together at their points of intersection to form a rigid structure having open cells dispersed therethrough and a reflecting face, and means on the reflecting face for passing a first frequency and reflecting a second frequency of incident microwave radiation.

A process for preparing a frequency selective surface comprises the steps of forming a slurry of ceramic fibers and a fusing agent, removing excess liquid from the slurry to form a mat, pressing the mat to the desired shape, drying the pressed shape, sintering the dried pressed shape to fuse the fibers, and applying a grid to a surface of the sintered piece.

More specifically, a frequency selective surface is fabricated by mixing a slurry of 250 milliliters of deionized water per 100 grams of fiber in a mixer operated at a speed such that the fibers are dispersed but not chopped. The pH of the slurry is reduced to about 3 by the addition of acid, and mixing is continued. The pH is then increased to about 8 by adding sodium hydroxide, and mixing is completed. After the slurry is washed under vacuum, a fusing agent is mixed into the slurry. The slurry is washed under vacuum and vacuum drained to form a mat. The mat is placed into a press and pressed to the desired shape. The pressed shape is dried, preferably in a drying oven by gradually increasing the temperature to about 70° C. to about 150° C. for about 12 hours. The body is completed by sintering in a furnace, preferably at a temperature of about 1295° C. for about 90 minutes, for the preferred boron nitride bonding agent, with both heating and cooling accomplished in less than about 1 hour.

The resulting material is a fibrous mass bonded together at points of intersection by the action of the fusing agent. The density of the fibrous mass can be controlled and varied by the processing, and most directly by the amount of fusing agent used. Higher amounts of fusing agent increase the density and result in higher modulus of elasticity and strength of the sintered final product, as well as a smoother surface.

The grid preferably is deposited onto a nonconducting film such as plastic by vapor deposition. The film is bonded to the face of the sintered body with an adhesive such as an epoxy.

It will now be appreciated that the microwave frequency selective surface of the invention presents a substantial advance in the art. The body of the frequency selective surface has the necessary physical, thermal and mechanical properties to allow operation in a space environment, without interfering with the microwave signals reflected therefrom or passed therethrough. Other features and advantages of the present invention will be apparent from the following more detailed description, taken in conjunction with the accompanying drawings, which description illustrates, by way of example, the principles of the invention.

SUMMARY OF THE INVENTION

Figure 1:
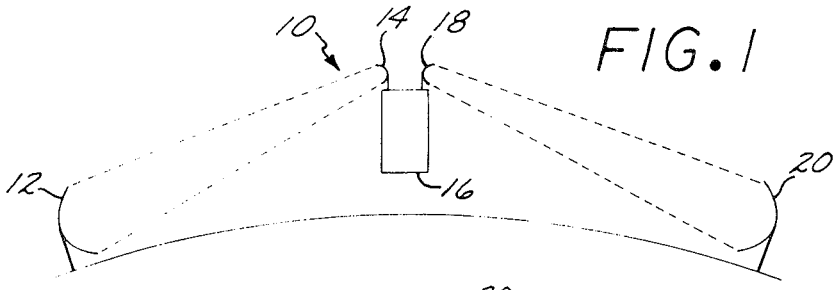
FIG. 1 is a perspective view of a communications satellite receiving and transmitting signals.

FIG. 1 illustrates the general configuration of a statellite communications system 10. Signals are radiated from a ground transmitting antenna 12 to a satellite receiving antenna 14 on a satellite 16. The signal is amplified by electronics in the satellite 16, and then emitted by a satellite transmitting antenna 18 to a ground receiving antenna 20, which may be located thousands of miles from the ground transmitting antenna 12. In many commercial and government communications applications, the satellite 16 is in a geostationary orbit at an altitude of about 22,300 miles above the equator of the earth. Such a satellite in geostationary orbit is stationary relative to locations on the ground, so that the antennas can also be relatively fixed and pointing at the same locations.

The signal used to transmit the communications is typically a microwave of frequency greater than 1000 megahertz. Microwave signals are not substantially attenuated by clouds, rain, and other earth interference, can transmit large amounts of information because of the high frequency, and can be readily signal processed both on the ground and in the satellite. More specifically, in typical communications systems the frequency of the signals is from about 4 gigahertz to about 22 gigahertz.

Figure 2:
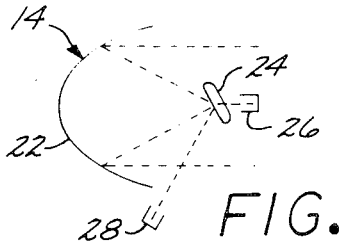
FIG. 2 is a side sectional view of an antenna system for receiving signals in a satellite, including a microwave frequency selective surface.

FIG. 2 depicts in more detail an antenna used on the satellite 16, here illustrated in relation to the antenna 14 used to receive signals from the earth but also applicable to the antenna 18 used to send signals to the earth. (The present invention could be used in conjunction with the ground antennas 12 and 20 also, but these antennas do not have the stringent weight and performance requirements imposed on the much smaller satellite antennas.) The antenna 14 includes an antenna reflector 22 having a parabolically curved reflecting surface covered with a metallic coating. Signals received by the reflector 22 are reflected toward the focus of the parabola. Near the focus, a microwave selective surface 24 is positioned to pass that portion of the signal having a first frequency to a first transceiver 26, and to reflect that portion of the signal having a second frequency to a second transceiver 28. It will be apparent that the portion of the signal containing the first frequency, which is passed through the selective surface 24, could actually have several frequencies contained therein. The first transceiver 26 could then be replaced by another frequency selective surface to reflect out another of the frequencies and pass the remaining frequencies therethrough. A number of frequencies could be extracted from the beam in this manner, with the primary limiting considerations being the available space and achieving a sufficiently low overall dissipation factor for the material of the frequency selective surface 24 that the signal passed through numerous selective surfaces 24 is not attenuated to a value below the limits of the signal processing electronics.

Figure 3:
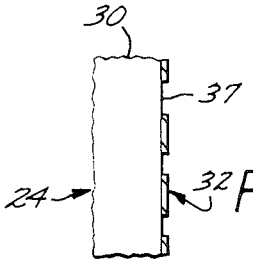
FIG. 3 is a side sectional view of a microwave frequency selective surface.
Figure 4:
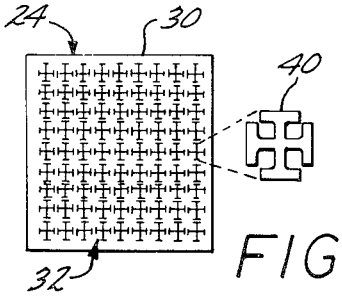
FIG. 4 is a top plan view of a microwave frequency selective surface.

FIGS. 3 and 4 illustrate the micowave selective surface 24 in greater detail. The microwave selective surface 24 comprises a body 30 to which is attached a metallic grid 32. The body 30 in turn comprises a plurality of ceramic fibers fused together at their points of intersection or contact to form a rigid structure having open cells dispersed through. A large number of ceramic fibers, each having a diameter of about 0.0001 to about 0.001 inches, are formed into a mat and then fused at their intersection points using a fusing agent and a sintering treatment.

Figure 5:
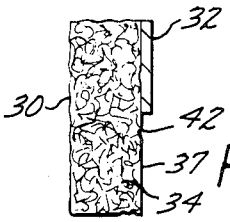
FIG. 5 is an enlarged, schematic side sectional view of the surface of a frequency selective surface.
Figure 6:
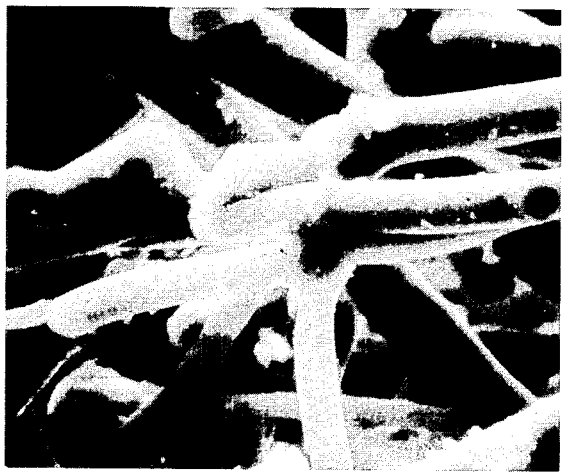
FIG. 6 is a photomicrograph of a fiber ceramic material used in the body of the microwave frequency selective surface.

FIG. 5 illustrates the resulting structure schematically, and FIG. 6 is a photomicrograph of the actual structure. The structure retains the fibers 34 in their original shape and size, but the fibers are rigidly fused together at their points of intersection 36 to form a rigid three-dimensional network. Between the fused fibers, there is a large volume fraction of open space whose presence results in a decreased density of the fibrous ceramic material. The term "cell" is used herein to denote the space between and bordered by the fused fibers, in the sense that a cellular type of enclosure for each space could be defined geometrically. The use of the term cell should not be taken to suggest that the open spaces are regular in shape or uniform in size, and in fact the cells and open spaces can vary considerably both in shape and size. The term cell should also not be taken to suggest that the space between the bonded fibers 34 is closed within itself, and in fact for the most part the open spaces or cells are continuous to produce a solid of interconnected porosity in a structure termed an open cellular structure. In the sense used herein, the microstructure of the solid body is a large number of fibers 34 fused at their points of intersection, which define the walls of an open cellular structure.

The fibers 34 used in the body 30 can be of any ceramic material that meets the productibility, structural, electrical and mechanical requirements of the antenna microwave selective surface 24. That is, the fibers should themselves be of low coefficient of thermal expansion, high melting point, low density, high modulus, and high strength, to impart these properties to the bonded material. They should also be electrically nonconducting, have a low dielectric constant, and have a low dissipation factor. Isotropy of the fibers themselves is not required, since the manner of combining the fibers in a generally random arrangement imparts isotropy to the bonded array of fibers even when the fibers themselves are somewhat anisotropic.

The preferred fibers are silicon dioxide ($SiO_2$), which meet the above requirements and are readily available in short lengths. The silicon dioxide fibers can be bonded together by various bonding agents. The preferred bonding agent is boron nitride, which is a fusing agent which aids in fusing the fibers together, with fusing achieved by sintering.

The fibers are desirably in a form that has a low coefficient of thermal expansion. In the case of silicon dioxide fibers, the silicon dioxide material has an amorphous form with a very low coefficient of thermal expansion. Other forms of silicon dioxide fiber, such as the crystalline mineral form cristobalite, have a much higher coefficient of thermal expansion, and should be avoided in manufacturing and use of the frequency selective surface, to reduce the thermal mismatch with the grid 32 and the possibility that the grid will thermally fatigue or delaminate from the body. The higher coefficient could also lead to distortion of the body 30 and the generation of internal stresses that could reduce the strength of the part.

Many other types of ceramic fibers can be substituted for the silicon dioxide fibers in whole or in part, or used in a mixture of silicon dioxide fibers with other fibers to achieve specifically tailored final properties. For example, aluminum oxide (alumina, or $Al_2O_3$) fibers and silicon carbide (SiC) fibers or powder have been incorporated in some instances to increase the strength and indentation hardness of the final product.

The fibers are bonded together at their points of intersection by a suitable technique. In principle, adhesives could be used, but they would be difficult to apply and would lose strength at elevated temperatures. Preferably, the fibers are fused together with the aid of a fusing agent.

The fusing agent is a high temperature material which aids in fusing the fibers together at their points of intersection, thereby giving strength and rigidity to the final bonded structure. The fusing agent must withstand high elevated temperatures without permitting debonding of the fibers, since an important advantage of the ceramic material is to withstand the high temperatures created when the frequency selective surface is struck by a laser beam. Since the ceramic material does not dissipate the heat of the laser beam quickly by conduction, it must withstand high temperatures. Boron nitride has been identified as the preferred fusing agent, since its presence permits the solid state sintering of the fibers together at their points of intersection. Other fusing agents can be used if they produce a similar result.

The cross section of the surface of the fused material is sketched in FIG. 5, with the photomicrograph of the actual structure shown in FIG. 6. The fibers retain their initial fibrous structure after fusing is complete, so that the surface reveals a plurality of fibers projecting outwardly. The cells remain between the fused fibers and, at the surface, are manifested as roughnesses 42, which can be depressions in the surface or projections above it. The lateral extent of the roughnesses 42 varies with the nature of the processing and the fusing agent used. The grid 32 is applied over the roughnesses, and tends to fill them with metal, resulting in a smoother surface in the areas where there is grid metal.

The roughnesses 42 should have a size much less than the wavelength of the microwave signal, so that the roughnesses 42 do not tend to trap the energy of the signal. The size of the roughnesses 42 can be reduced by increasing the as-fused density of the ceramic material making up the body 34, as for example by using greater pressing pressure during processing or using a greater amount of fusing agent to promote densification of the fused material.

The grid can be added by any convenient technique to a reflecting face 37, such as vapor metallization or physically attaching a metallic layer to the surface. The most common and preferred metallic materials for the grid 32 are gold and copper, but metals having higher melting points, such as tungsten, can also be used to resist damage by a laser beam directed at the microwave selective surface 24.

The form of the grid 32 is selected according to the nature of the signal to be reflected. In the preferred embodiment, the grid comprises a repeating pattern of elements 38, each of which elements is an equiaxed cross 40 having cross pieces at the end of each arm, such as depicted in the inset to FIG. 4. That is, each element is in the form of a plus sign (+) with an enlargement at the end of each projecting arm of the cross. This geometry is sometimes termed a Jerusalem cross. A repeating square grid of such elements, each having a center to center spacing of about 0.6 centimeters, is an effective reflector of microwave signals. Other geometries of the grid are also expected to be operable.

A procedure has been developed to fabricate pieces, such as the bodies of microwave selective surfaces, of the fibrous ceramic material. In preparing pieces, fibers of a single type or combinations of types were weighed and then mixed together in a water slurry, with 250 milliliters of deionized water for each 100 grams of fiber. The mixer was operated for two minutes at a slow speed to disperse the bundles of fibers without chopping them. The pH of the slurry was reduced from 7 down to 3 with the addition of a 10 percent HCl solution, and mixing continued for 5 minutes. The pH of the slurry was increased to about 8 with the addition of a 10 percent NaOH solution, and mixing continued for 5 minutes.

The slurry was poured into a vacuum liquid extraction device, wherein a cylinder was mounted upon a vacuum flask, with a filter between the two. A vacuum of 44.8 torr was maintained in the flask, and the slurry was poured into the cylinder. The liquid was removed into the vacuum flask and the fibrous material retained on the filter. The retained material was washed with a volume of deionized water, which was also removed into the vacuum flask.

The wet compact was removed and mixed for two minutes with 250 ml of deionized water for each 100 grams of fiber and the fusing agent. In this work, boron nitride was used as the fusing agent. The mixture was placed in the cylinder above the vacuum flask and the liquid removed.

The wet but drained mixture was then placed into a die of the desired final shape and pressed under a load using a hydraulic press to form a mat. The pressed mat had sufficient strength for handling in subsequent operations.

The pressed mat was placed into a drying oven operating at about 70° C., and the temperature gradually increased over a 6 hour period to about 150° C. The material was held at this temperature for an additional 6 hours to ensure that all moisture within the pressed mat had been removed. Removal of the moisture is thought to be important, because the presence of moisture promotes formation of cristobalite in subsequent sintering. At the beginning of this drying step, the wet mat typically contains up to about 75 percent by weight water. If the water is removed too quickly, it causes the compact to expand and the fibers to break, which weakens the final product.

The dried piece was then sintered in air at a temperature of about 1295° C. for 90 minutes. The piece was heated to this temperature before sintering in less than one hour, and cooled after sintering to room temperature in less than one hour.

A number of compositions and processing conditions were evaluated to determine the most preferred composition for the fibrous ceramic of the body of the frequency selective surface, with the processing conditions otherwise as indicated in the immediately preceding paragraphs. The starting materials were as follows:

Silicon dioxide fibers were amorphous, 99.7 percent pure material, with a diameter of about 1.4 micrometers and a length to diameter ratio ranging from 0.07 to 9.3. (Thus, the term "fiber" is seen to be used herein in a generic sense, and can cover elements which have a length to diameter ratio less than 1.) The density of the fibers, which is to be distinguished from the density of the final product, was 2.32 grams per cubic centimeter. The fibers were obtained as Q-fibers from Johns Manville company.

Aluminum oxide fibers were crystalline material of 95 percent $Al_2O_3$ and 5 percent $SiO_2$, with a diameter of 3 micrometers. The density was 3.40 grams per cubic centimeter, and the fibers were supplied by Saffil.

Silicon carbide whisker fibers were alpha silicon carbide, 99.1 percent pure material. They had a diameter of about 0.6 micrometers and a length to diameter ratio of from 17 to 133. The density of the fibers was 3.2. The fibers were obtained as SILAR SC-9 material from the Silag division of Arco Metals.

Boron nitride powdered fusing agent was 99.5 percent purity with a mean diameter of less than 43 micrometers. Its density was 2.25, and the powder was obtained from AESAR Chemica.

A number of samples were made, and the materials used and conditions are summarized in the following table. In preparing the data of the table, the hardness value was determined by pressing a 1.02 millimeter diameter probe into the surface of the piece and then measuring the indentation strength using a Shore A hardness gauge. A dial indicator measured the resistance of the material to the indentation. The relative specific strength value was obtained by dividing the indentation strength (Shore A hardness) by the bulk geometric density.

| No. | Composition[1] (weight pct) | Density gm/cubic cm | Pressing Press (psi) | Hardness Shore A | Specific Strength |
|---|---|---|---|---|---|
| 1 | 97-0-3-0 | — | 133.7 | 70 | — |
| 2 | 78-22-0-0 | 0.68 | 66.8 | 88 | 129 |
| 3 | 76-21-3-0 | 0.24 | 10.1 | 48 | 200 |
| 4 | 76-21-3-0 | 0.24 | 10.1 | 53 | 221 |
| 5 | 78-22-0-0 | 0.21 | 10.1 | 28 | 133 |
| 6 | 76-21-3-0 | 0.44 | 33.7 | 90 | 205 |
| 7 | 78-22-0-0 | 0.44 | 33.7 | 50 | 114 |
| 8 | 74-21-3-2 | 0.24 | hand | 35 | 146 |
| 9 | 74-21-3-2 | 0.25 | hand | 55 | 220 |
| 10 | 76-21-3-0 | 0.11 | hand | — | — |
| 11 | 80-14-6-0 | 0.32 | — | 60 | 219 |
| 12 | 78-19-3-0 | 0.25 | — | 40 | 160 |
| 13 | 80-11-6-3 | 0.49 | — | 60 | 122 |
| 14 | 75-19-3-3 | 0.26 | — | 40 | 154 |
| 15 | 75-19-3-3 | 0.23 | — | 55 | 239 |
| 16 | 73-18-3-6 | 0.21 | 7.2 | 55 | 238 |
| 17 | 69-21-3-7 | 0.12 | squeezed wet | 15 | 125 |
| 18 | 71-20-3-6 | 0.23 | 7.3 | 55 | 239 |
| 19 | 71-20-3-6 | 0.19 | 7.3 | 45 | 236 |
| 20 | 74-20-3-3 | 0.23 | 9.9 | 50 | 218 |

[1]in the order silicon dioxide-aluminum oxide-boron nitride-silicon carbide

From these data, it was determined that additions of aluminum oxide and silicon carbide fibers increase the strength and indentation hardness of the fibrous ceramic material. The flexural strengths of specimens having silicon carbide were in the range of 100–200 pounds per square inch (psi), while the strengths of specimens without silicon carbide were in the range of about 70 psi. Additions of silicon carbide of greater than about 3 percent do not yield further indentation strength increases, and as a result this value is thought to be the optimum silicon carbide content because further additions increase weight without increasing strength.

The boron nitride fusing agent is present to fuse the silicon dioxide and aluminum oxide fibers together. Increasing amounts of boron nitride increase the density of the final sintered material. For example, 6 percent of boron nitride increased the density to as high as 0.49 grams per cubic centimeter.

The compaction load also helps determine the final density. The higher loads increased the indentation strength but also increased the density. The optimum compaction pressure was found to be about 10 pounds per square inch, which resulted in a bulk density of 0.23 grams per cubic centimeter and a hardness of 50.

The processing procedure and compositions described resulted in a negligibly small amount of cristobalite formation, as desired. The presence of cristobalite is deleterious to properties due to the large volume change which occurs in the crystalline form when heating in the range of 200° to 270° C. X-ray diffraction patterns of the specimens were prepared and analyzed. They showed no cristobalite in the specimens.

Based upon the optimization of the composition and processing, the most preferred composition of the fibrous ceramic material in weight percent is found to be about 74 percent silcon dioxide, 20 percent aluminum oxide, 3 percent boron nitride, and 3 percent silicon carbide, pressed at a pressure of about 10 psi.

The body of the microwave selective surface of the present invention thus has the acceptably high strength and low density needed for use in a satellite communications system. It is formed of ceramic materials which have an inherently low coefficient of thermal expansion and are assembled in a manner that produces isotropic expansion properties. The body may be made flat, or curved to concentrate and amplify the reflected microwave signal in the manner of a concentrating mirror. The surface is transparent to microwave frequency signals, and has a low dielectric constant for low refraction of the signal and a low dissipation factor for low attenuation of the signal. The surface of the ceramic material may be readily coated with the metallic grid to reflect the signal, and the surface can be made with sufficiently small surface irregularities that it is suitable for reflection of micrometer-range wavelength signals. Various types of fibers can be incorporated into the solid body, so that it can be tailored to meet a range of operating requirements. Thus, the present invention represents an important advance in the art of spacecraft microwave frequency selective surfaces. Although a particular embodiment of the invention has been described in detail for purposes of illustration, various modifications may be made without departing from the spirit and scope of the invention. Accordingly, the invention is not to be limited except as by the appended claims.

What is claimed is:

1. A frequency selective surface for selectively reflecting microwave radiation, comprising:

a body of a cellular ceramic material wherein a plurality of ceramic fibers are bonded together at their points of intersection to form a rigid structure having open cells dispersed therethrough and a reflecting face, and a metallic grid on said reflecting face, said grid being a repeating pattern of elements, which pattern passes a first frequency and reflects a second frequency of incident microwave radiation.

2. The frequency selective surface of claim 1, wherein said grid is supported on a nonmetallic film attached to said reflecting face.

3. The frequency selective surface of claim 1, wherein said grid is about one micrometer thick.

4. The frequency selective surface of claim 1, wherein said grid is deposited upon said reflecting face.

5. The frequency selective surface of claim 1, wherein said grid is formed of a metal selected from the group consisting of gold, copper and tungsten, and alloys thereof.

6. The frequency selective surface of claim 1, wherein said reflecting face is flat.

7. The frequency selective surface of claim 1, wherein said grid comprises a repetitive rectilinear pattern of Jerusalem crosses.

8. The frequency selective surface of claim 1, wherein said ceramic fibers include silicon dioxide fibers.

9. The frequency selective surface of claim 1, wherein said ceramic fibers include silicon dioxide fibers and aluminum oxide fibers.

10. The frequency selective surface of claim 1, wherein said ceramic fibers are fused together by a fusing agent.

11. The frequency selective surface of claim 10, wherein said fusing agent is boron nitride.

12. The frequency selective surface of claim 1, wherein the composition of said body in weight percent is about 74 percent silicon dioxide, 20 percent aluminum oxide, 3 percent boron nitride, and 3 percent silicon carbide.

13. The frequency selective surface of claim 1 wherein said cellular ceramic material is arrayed in layers lying parallel to said reflecting face, adjacent layers having different densities of said ceramic material.

14. The frequency selective surface of claim 1, wherein the density of said body is from about 0.1 to about 0.5 grams per cubic centimeter.

15. A frequency selective surface for selectively reflecting microwave radiation, comprising:

a body of a cellular ceramic material wherein a plurality of ceramic fibers are bonded together at their points of intersection to form a rigid structure having open cells dispersed therethrough and a reflecting face; and means on said reflecting face for passing a first frequency and reflecting a second frequency of incident microwave radiation.

16. The frequency selective surface of claim 15, wherein said body is curved concavely in respect to said reflecting face.

17. The frequency selective surface of claim 15, wherein said means is a grid of regularly repeating elements.

* * * * *